United States Patent [19]

Cho

[11] Patent Number: 4,903,250

[45] Date of Patent: Feb. 20, 1990

[54] WRIST WATCH WITH MEMO CASE

[76] Inventor: Kang-Rai Cho, 207-305 Garak-Samik Mansion, 395 Pangi-dong, Songpa-ku, Seoul, Rep. of Korea

[21] Appl. No.: 204,305

[22] Filed: Jul. 29, 1988

[30] Foreign Application Priority Data

Jun. 16, 1987 [KR] Rep. of Korea ..... 9552/1987

[51] Int. Cl.[4] ..... G04B 45/00

[52] U.S. Cl. ..... 368/41; 368/281

[58] Field of Search ..... 368/41–44, 368/281–283

[56] References Cited

U.S. PATENT DOCUMENTS 1,539,781 5/1925 Smythe ..... 368/41

1,968,444 7/1934 Farber ..... 368/41

3,233,401 2/1966 Hoffman et al. ..... 368/41

*Primary Examiner*—Bernard Roskoski

*Attorney, Agent, or Firm*—Waldron & Associates

[57] ABSTRACT

Disclosed is a wrist watch having a memo case comprising a plate member integrally provided adjacent to the one side of a time display face, a boundary protrusion formed along the peripheral edge of the plate member, a foldable lid having an opening thereon, and a pad of paper sheets retained inside the lid and the boundary protrusion so that the uppermost paper sheet will be exposed, in turn, through the opening for writing down the main points in daily life, or a pad of printed cards being retained inside them for providing students with memory cards.

3 Claims, 3 Drawing Sheets

WRIST WATCH WITH MEMO CASE

BACKGROUND OF THE INVENTION

The present invention relates to an improved wrist watch provided with a memo case for writing down important points in daily life.

The wrist watches which are presently offered for sale in the marketplace can do much more than merely indicate the time. Date or calendar functions are common, and some wrist watches may also be used as calculators, stop watches, alarm clocks, and game machines.

Even though numerous wrist watch models have been proposed, no wrist watch model has ever been truly satisfactory.

In daily life, it is a common practice to carry along small memo pads or check books in order to write down such information, as telephone number, schedule, and date.

However, the problem is the bulk and unattractive appearance created by placing a memo pad or check book on shirt pockets or coat pockets.

Another problem is that small pads or check books, placed in an open shirt or coat pocket, tend to fall out when one bends over, walks fast or runs.

On the other hand, it can be very inconvenient not to have something to write on, and occasionally one has no choice but to write meeting date, place and time on a piece of the newspaper, or worse, on one's palm especially during a telephone conversation.

Moreover, there is a definite limit to how much a human being's mind can take, and one frequently forgets important schedules.

SUMMARY OF THE INVENTION

A primary object of the present invention therefore is to solve all of the foregoing problems by providing an improved wrist watch along with a memo case for retaining a pad of paper sheets on which the main points or the schedule in daily life can be written.

Another object of the present invention is to provide an improved wrist watch with a memo case which is easier to record essential particulars and is more convenient to display information than the conventional wrist watch.

The above objects of the invention can be attained as desired from an improvement in a wrist watch comprising of a memo case including a plate member integrally provided adjacent to the one side of a display face, a boundary protrusion formed along the peripheral edge of the plate member, a foldable lid having an opening thereon, attached to the plate member by a hinged joint for engaging with the boundary protrusion, a pad of paper sheets retained inside the lid and the boundary protrusion, and fastening means between the lid and the boundary protrusion including a projection resiliently attached to the lid and a recess defined on the one side of the plate member.

The configuration of a memo case in accordance with a preferred embodiment of the present invention may be of square, circular oval, curvilinear angular or polygonal or any combination of them.

Furthermore, the pad of paper sheets in accordance with a preferred embodiment of the present invention may be replaced as printed cards for providing students with studying cards.

In addition to the employment of the advantageous construction of a wrist watch with a memo case as noted above, one paper sheet is exposed, in turn, through the opening of the lid on which the important points in daily life can be easily written.

Moreover, an idea instantaneously arising from the wearer may be written on the paper sheet at once, thereby being helpful for recording a new idea.

The pad of paper sheets can be replaced with printed cards on which English words, mathematic formulae and the like may be printed so that they will assist students in studying school work.

These and other objects as well as advantages of the present invention will become clear by the following description of preferred embodiments of the present invention with reference to the accompanying drawings.

DETAILED DESCRIPTION OF PREFERRED EMBODIMENTS

Figure 1:
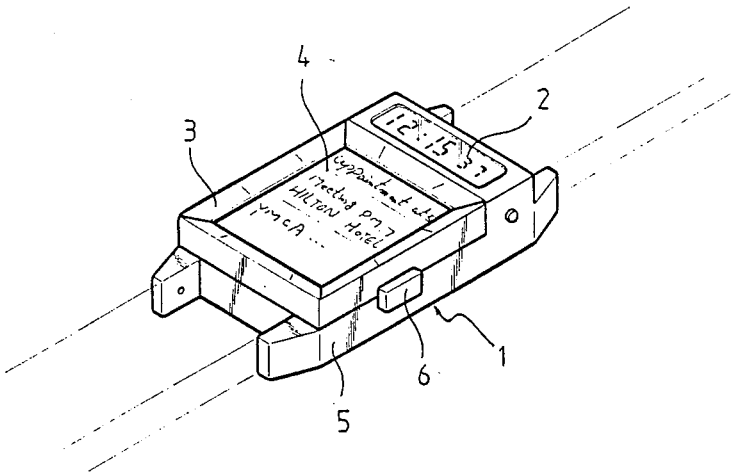
FIG. 1 is a perspective view of an embodiment of the wrist watch with the memo case according to the present invention.

An embodiment of the wrist watch with the memo case of the present invention will be first explained in the following with reference to FIGS. 1 to 3. Next, two embodiments of the wrist watch with the memo case of the present invention will be described with reference to FIGS. 4 and 5.

Referring now to an embodiment of FIGS. from 1 to 3, the wrist watch with the memo case in accordance with the present invention comprises a digital type display face 2 and a memo case 1 integrally provided immediately below the display face 2.

The memo case 1 includes a plate member 5 integrally extended downwardly from the display face 2, a boundary protrusion 5' formed along the peripheral edge of the plate member 5, and a lid 3 having an opening 3' which is foldably hinged to the one side of the plate member 5 in the normal manner and also is adapted to lock by the engagement between a projection 6 resiliently attached to the lid 3 and a recess 6' defined on the one side of the plate member 5.

A pad of paper sheets 4 will be inserted in the boundary protrusion 5' and then will be covered by the lid 3 for retaining the paper sheets 4.

On the other hand, a magnifying glass (not shown) may be attached to the opening 3' when a pad of printed cards in stead of the pad of paper sheets 4 will be inserted in the boundary protrusion 5', so that the letter of the printed cards can be seen through the magnifying glass in a magnified state.

With this construction of the memo case 1 of the wrist watch, a pad of the paper sheets 4 can be easily inserted in the boundary protrusion 5', and then will be covered by the lid 3 for retaining the paper sheets 4.

Accordingly, a surface of the uppermost paper sheet among the paper sheets 4 will be exposed through the opening 3', so that main points in daily life, for instance, meeting date, time and place and the like can be written on the exposed paper sheet.

Furthermore, the pad of the paper sheets 4 can be replaced with printed cards, for example, English words, mathematic formulae or the like, so as to assist students in studying the school work.

Although reference have been made to a specific preferred embodiment of the invention, it is to be understood that the present invention is not restricted in the details of arrangement, but rather that the invention may be reduced to practice in various other ways.

Figure 2:
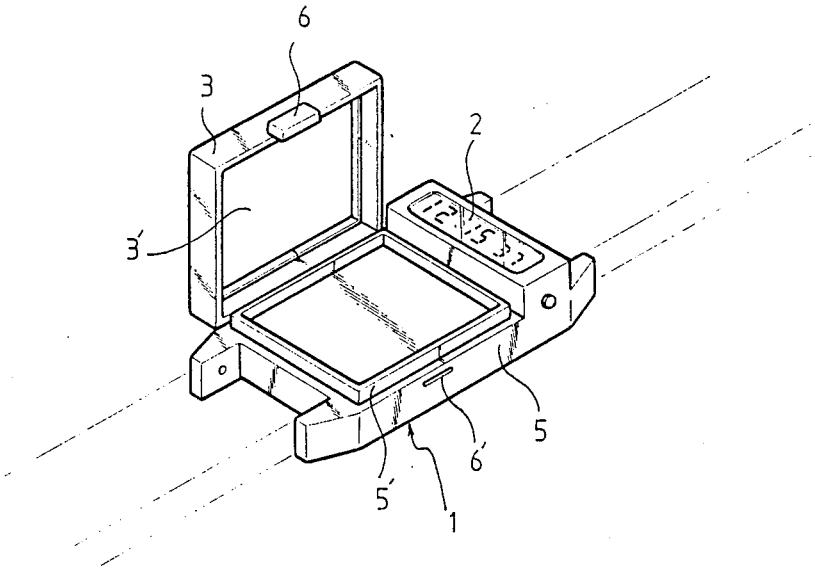
FIG. 2 is a perspective view showing the lid of the memo case in open state illustrated in FIG. 1
Figure 3:
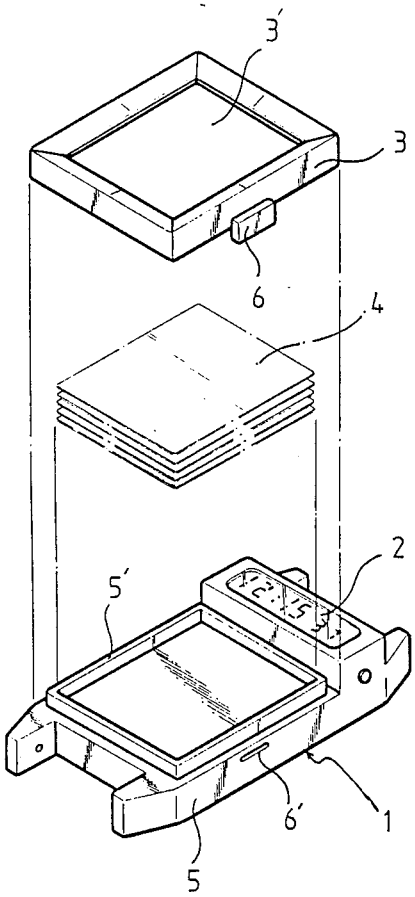
FIG. 3 is an exploded perspective view showing the lid, and a pad of paper sheets in dismantled state illustrated in FIG. 1.
Figure 4:
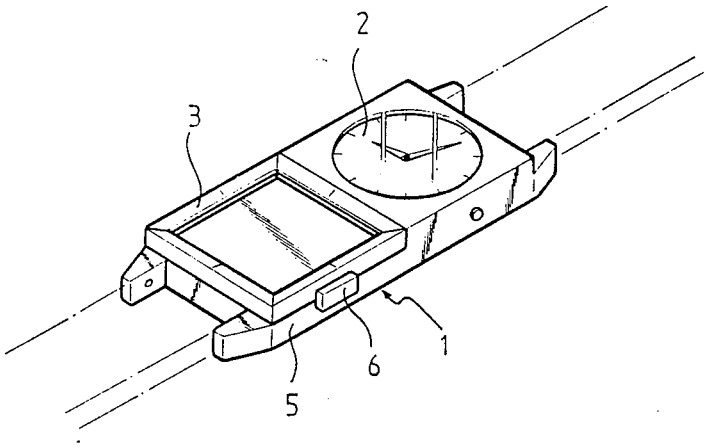
FIG. 4 is a perspective view of another embodiment of the wrist watch with the memo case according to the present invention.

Now referring to FIG. 4, there is shown another embodiment wherein there is provided the display face 2 which is not a digital type display but an analog type display, and the other constructions are the same as shown in FIGS. 1 to 3.

Figure 5:
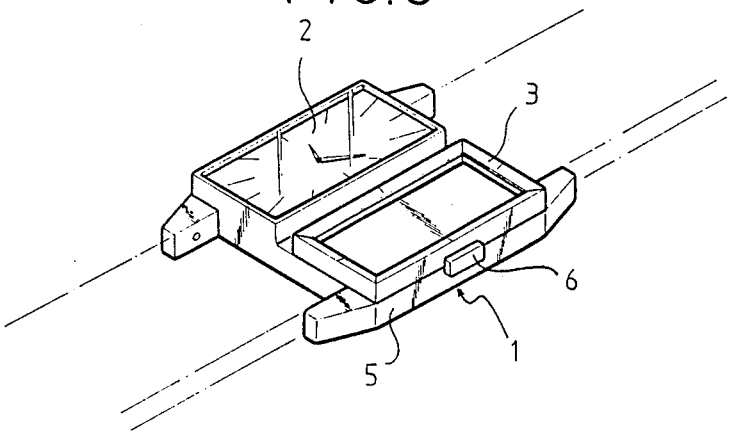
FIG. 5 is a perspective view of a further embodiment of the wrist watch with the memo case according to the present invention.

As shown in FIG. 5, there is a further improved embodiment in which the memo case 1 is provided the immediately next to the display face 2 in the right side, and also the other constructions are the same as shown in FIGS. 1–3.

Thus, it is of course feasible in practice that the memo case 1 may be provided to any side of the display face 2, and that the configuration of the memo case may be of square, circular, oval, curvilinear, angular or polygonal or any combination of them.

It is also to be understood that the appended claims are intended to cover all of such generic and specific features particular to the invention as disclosed herein and all statement relating to the scope of the invention, which as a matter of language might be said to fall thereunder.

What is claimed is:

1. In combination a wrist watch including a time means for measuring and displaying time, and a memo case, said memo case comprising:

a plate member integrally provided adjacent to said time means;

a boundary protrusion formed along the peripheral edge of said plate member and adapted to receive a pad of paper sheets retained within said boundary protrusion;

a lid attached to said plate member by a hinged joint adapted to be hingedly moved between an open position to permit insertion and removal of said paper sheets and a close position to retain said paper sheets within said boundary protrusion, said lid having an opening thereon sufficient to permit said paper to be seen when said lid is in the closed position; and fastening means on said lid and adapted to releasably fasten said lid in a closed position in engagement with said boundary protrusion.

2. A wrist watch with a memo case as claimed in claim 1, wherein said pad of paper sheets further comprises a pad of printed cards.

3. A wrist watch with a memo case as claimed in claim 1, wherein said lid further comprises a magnifying glass to be fitted to said opening thereon.

* * * * *